US008485490B1

(12) United States Patent
Miller

(10) Patent No.: US 8,485,490 B1
(45) Date of Patent: Jul. 16, 2013

(54) BEVERAGE CUP POPCORN CONTAINER HOLDING DEVICE

(75) Inventor: Gary Denton Miller, Spanaway, WA (US)

(73) Assignee: Gary D. Miller, Tacoma, WA (US)

( * ) Notice: Subject to any disclaimer, the term of this patent is extended or adjusted under 35 U.S.C. 154(b) by 208 days.

(21) Appl. No.: 12/963,916

(22) Filed: Dec. 9, 2010

Related U.S. Application Data

(60) Provisional application No. 61/283,975, filed on Dec. 11, 2009.

(51) Int. Cl.
*A47B 97/04* (2006.01)
*A47B 97/06* (2006.01)
*A47C 7/62* (2006.01)

(52) U.S. Cl.
USPC ..... 248/444; 248/451; 248/442.2; 248/441.1; 297/188.01

(58) Field of Classification Search
USPC ..... 24/3.11, 3.12, 329, 331, 338, 499, 24/531, 335, 336, 457; 248/689, 447.2, 213.2, 248/229.1, 229.16
See application file for complete search history.

(56) References Cited

U.S. PATENT DOCUMENTS 5,697,594 A * 12/1997 Adams et al. ..... 248/442.2
2007/0057540 A1* 3/2007 Brenner ..... 297/188.01

* cited by examiner

*Primary Examiner* — Jonathan Liu
*Assistant Examiner* — Erin W Smith

(57) ABSTRACT

A holding device used to temporarily hold a container of popcorn in an upright position using a nearby beverage cup holder. The holding device includes a planar main body with a forward extending, transversely aligned curb with a planar receiving space formed below the curb. Formed on the receiving space is a line of raised teeth separated by indentations and at least one spike. Mounted on the main body is a biased, pivoting clip with a lower serrated edge that forcibly presses into the indentations formed between the raised teeth on the receiving space. Located on the rear surface of the main body is a downward extending beverage cup edge engaging structure. Attached to the main body or the cup edge engaging structure is a handle. During use, the serrated edge on the clip is forced against the edge of the popcorn container to prevent its dislodgement.

18 Claims, 4 Drawing Sheets

Fig. 4
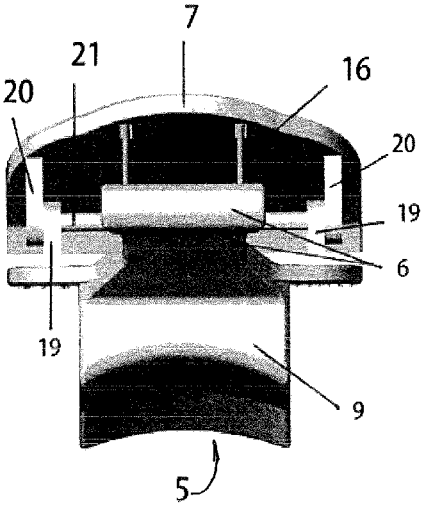
Fig 5
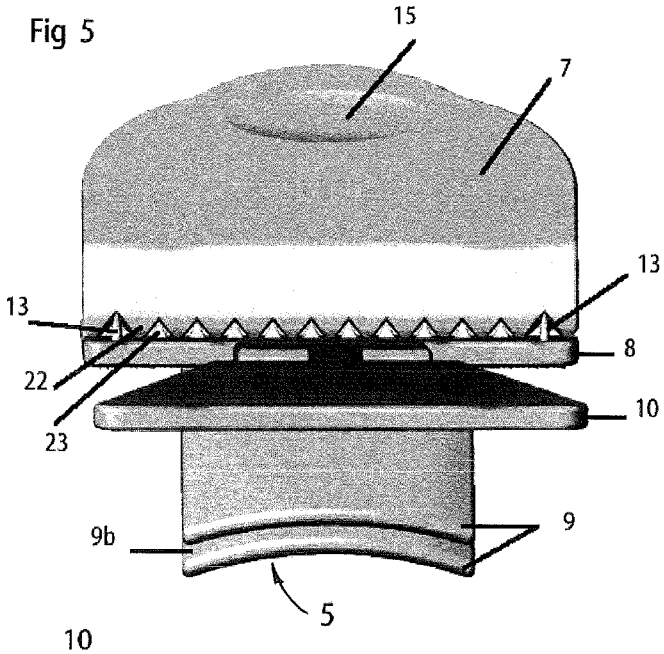
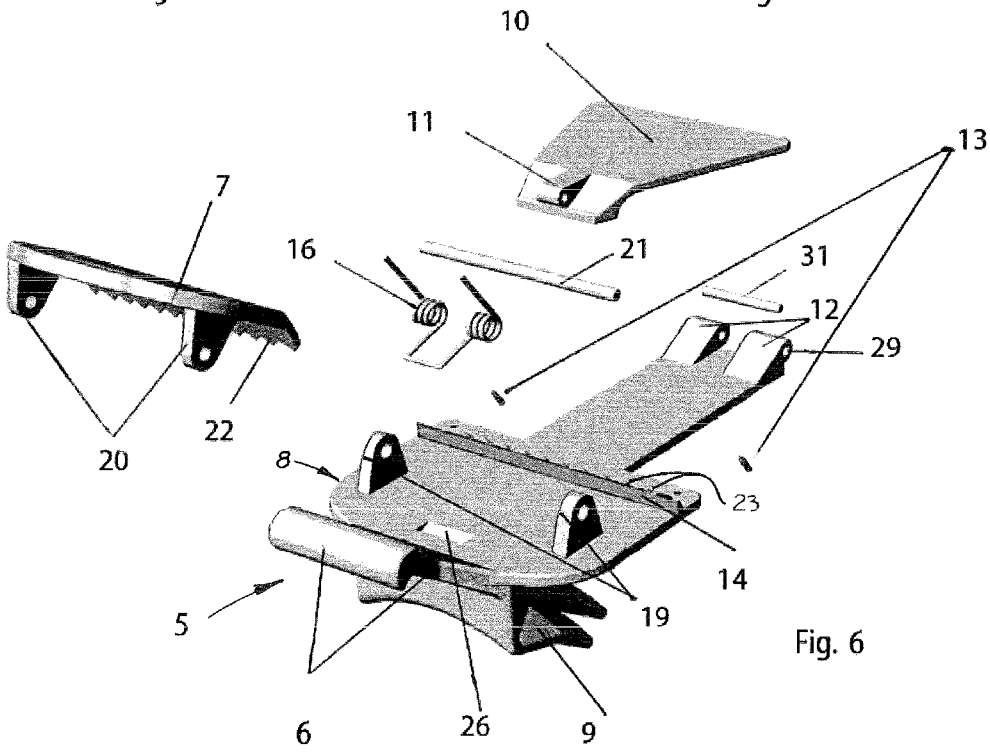
Fig. 6

BEVERAGE CUP POPCORN CONTAINER HOLDING DEVICE

COPYRIGHT NOTICE

Notice is hereby given that the following patent document contains original material which is subject to copyright protection. The copyright owner has no objection to the facsimile or digital download reproduction of all or part of the patent document, but otherwise reserves all copyrights whatsoever.

This utility patent application is based on and claims the priority filing date of U.S. provisional patent application (Ser. No. 61/283,975) filed on Dec. 9, 2009.

BACKGROUND OF THE INVENTION

1. Field of the Invention

This invention relates container holding devices and more particularly, to holding devices used to temporarily support and hold a container filled with popped popcorn on a standard seat or aisle beverage cup holder.

2. Description of the Related Art

This invention came about because of the desire of patrons at a movie theater or sports arena not wanting to hold their popcorn containers (buckets or bags) on their laps and continually moving the popcorn container into a position to eat or share with someone sitting adjacent to them. By simply clipping the popcorn container onto the seat or aisle beverage cup holder located equal distance from each patron, they may easily share and access the popcorn container.

SUMMARY OF THE INVENTION

Described herein is a portable popcorn bucket and bag holding device designed to hold any size and shape of a popcorn bucket or bag, hereinafter called a popcorn container, on the edge of a standard beverage cup holder normally found on the arm of a theater chair or on the back on a sports arena chair. The holding device is designed to easily slip ON and OFF the beverage cup holder with one hand when a beverage cup is in the beverage cup holder and without scratching or damaging the seat arm, the seat back or the beverage cup holder.

The holding device includes a beverage cup holding engaging structure and a handle that is spaced apart from the device's main body and from a specially designed container locking clip. In the preferred embodiment, the handle is a 2-way gripping handle that allows the user to grip the handle with one hand between two fingers located on the front and back surfaces or on the two end surfaces. If needed, the user may easily slip the holding device ON or OFF with the beverage cup holder when patrons pass through the aisle. The holding device is designed to securely grip the popcorn container so that the user and a guest may exert downward pressure into the popcorn container to grasp a handful of popcorn and remove it from the popcorn container. The holding device is also securely attached to the popcorn container so that other patrons in the aisle may brush against it without dislodging the holding device from the beverage cup holder or dislodging the popcorn container from the holding device.

More specifically, the holding device includes a planar main body with a rear surface and a front surface. Formed on the lower section of the front surface is a forward extending, transversely aligned curb. Connected to the rear surface is a downward extending beverage cup engaging structure. The curb is located inward and upward from the main body's lower edge thereby creating a planar receiving space on the main body. Located on the receiving space and below the curb are a plurality of optional raised teeth aligned in a transversely aligned row on the main body. The teeth are spaced apart thereby forming indentations in between them. Also mounted on the planar receiving space and below the curb and line of raised teeth is at least one upward, diagonally extending spike.

Mounted on the main body is a biased, pivoting clip with a lower serrated edge that forcibly presses into the indentations located between the line of teeth on the planar receiving space. During use, lower edge of the clip is lifted from the main body and the edge of the popcorn container is placed over the planar receiving space and around the curb, the line of teeth, and the spike. When the clip is released, the clips serrated edge pressed against the inside surface of the popcorn container and forces it against the curb, the line of teeth and the spike to prevent the container from dislodging.

As stated above, attached to the main body or to the cup engaging structure is an upward extending handle that enables the holding device to be easily attached and detached from the edge of a beverage cup holder. In one embodiment, the handle is a 2-way gripping structure designed to allow the user to grip the handle with the fingers oriented in two different directions and lift the holding device from the beverage cup holder.

In one embodiment, the holding device includes a support arm that that extends downward from the main body to support the rear surface of the popcorn container. In still another embodiment, the holding device may include a pivoting extension arm with a wide section that extends below the support arm and provide additional rear support for larger popcorn containers.

The holding device includes several wide surfaces on which marketing and advertising indicia may be printed.

DESCRIPTION OF THE DRAWINGS

FIG. 4 is a top plan view of the invention shown in FIGS. 2 and 3.

FIG. 5 is a bottom view of the invention shown in FIGS. 2-4.

FIG. 6 is an exploded isometric view with the invention shown in FIGS. 2-5.

DESCRIPTION OF THE PREFERRED EMBODIMENT(S)

Figure 1:
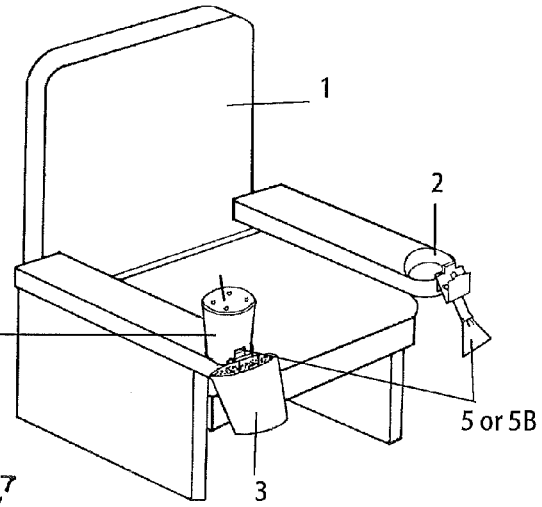
FIG. 1 shows an isometric drawing of a theater seat with two popcorn container holding devices attached to the front edges of two beverage cup holders with one popcorn container being attached to one holding device and tilted at a 35 degree angle for easy access by patrons sitting in adjacent seats.

FIG. 1 shows an isometric drawing of a theater seat 1 with two popcorn container holding devices 5 and 5B attached to the front edges of two beverage cup holders 2 with one popcorn container 3 being attached to one holding device 5 and tilted at a 35 degree angle for easy access by patrons (not shown) sitting in adjacent seats (not shown).

The holding device 5 is designed to temporarily hold a popcorn container 3 at a fixed 35 degree angle for easy access of the popcorn without obstructing the removal or insertion of a beverage cup 4 from the beverage cup holder 2. The holding device 5 includes a handle 6 that enables the holding device 5 to be easily aligned over the beverage cup holder 2 and then slidingly engage the vertical side wall of the beverage cup holder 2. In the preferred embodiment, the handle 6 is modified to act as a 2-way pull-up handle with a cylindrical transversely aligned top edge 6A and a narrow neck 6B. During use, the user can easily grasp the handle 6 by one hand using two fingers aligned over the front and back surfaces of the handle 6 or over the two opposite end surfaces.

Figure 2:
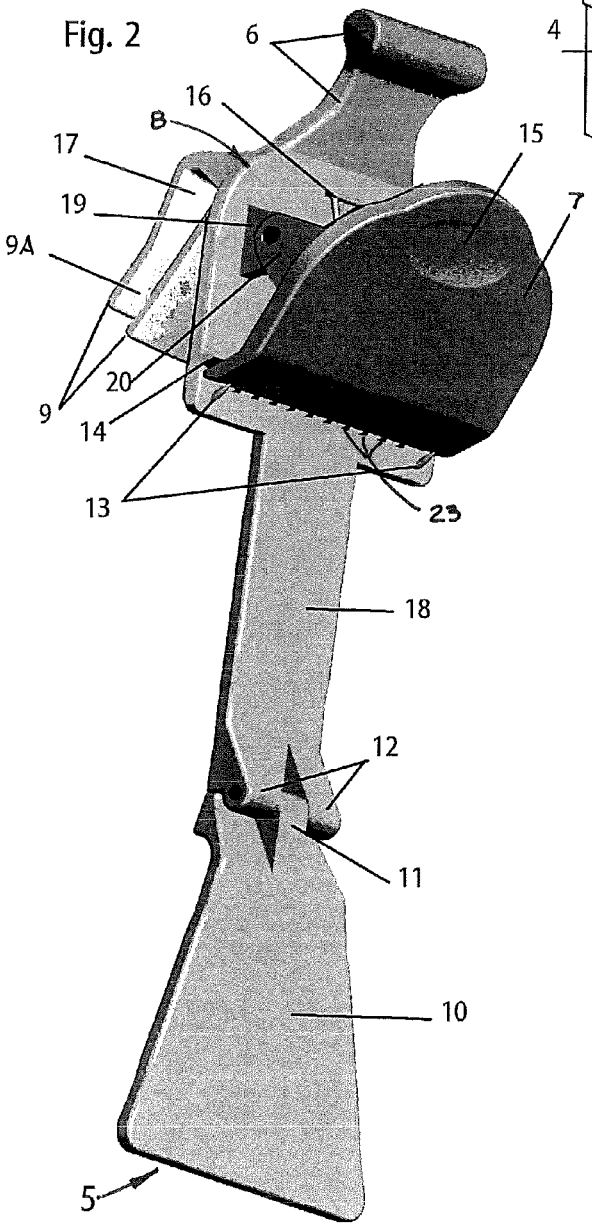
FIG. 2 is a front perspective view of the first embodiment of the invention.

FIGS. 2-11 depict two embodiments of the holding device, indicated by reference numbers 5 and 5*b*. FIG. 2 is an enlarged view of the first embodiment of the holding device 5 that includes a cup sleeve 9 with a slot 9A formed thereon designed to slide over and engage over the exposed, vertical side wall of standard beverage cup holder 2. The cup sleeve 9 is made of flexible plastic that enables the slot 9A to resist and selectively expand so that the slot 9A can received different thicknesses of sidewalls on cup holders 2. The cup sleeve 9 extends outward thereby forming a wider top space within the slot 9A to accommodate a lip on the edge on the beverage cup holder 2. A standard cup holder 2 has a side wall thickness ranging from ⅛ in. to ¼ in.

Figure 3:
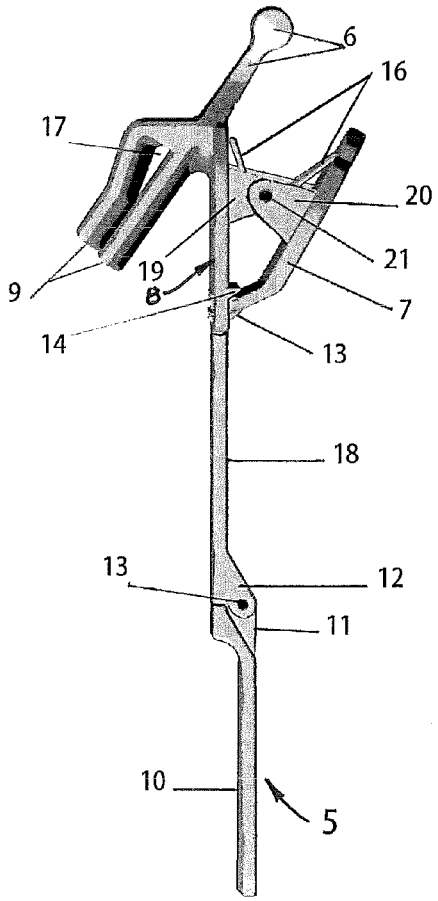
FIG. 3 is a side elevational view of the invention shown in FIG. 2.

As shown in FIGS. 2-4, the holding device 5 includes a main body 8 with two integrally formed hinge brackets 19 located on its front surface. Formed on the lower section of the front surface of the main body 8 is a transversely aligned raised curb 14. The curb 14 is located above the lower edge of the main body 8 thereby forming a planar receiving space 14B. Located below the curb 14 is a line of raised teeth 23. The individual teeth 23 are spaced apart thereby forming small indentations 25 between the teeth 23.

Formed on the planar receiving space 14B is at least one diagonally upward extending spike 13. In the preferred embodiment, two spikes 13 are provided on opposite sides of the main body 8. The spikes 13 are aligned at approximately 35 degrees from the main body 8 and extend in between indentations formed on the serrated edge of the clip 8 discussed further below. Also, in the preferred embodiment, the spikes 13 measure approximately 3⁄16 inch in length.

The two hinge brackets 19 include two bores that receive a pin 21. The pin 21 extends through two arms 20 located on the back surface of a pivoting clip 7. Disposed around the pin 21 and engaging the clip 7 and the main body 8 is a coil spring 16. The coil spring 16 includes two opposite legs that extend upward and engage slots formed on the back surface of the clip 7 near the top edge. The clip 7 also includes a center rectangular leg section that extends rearward from the pin 21 and extends an indentation formed on the front surface of the main body 8 near the top edge. During operation, the coil spring 16 applies a biasing force between the clip 16 and the main body 8 forcing the clip's lower serrated edge against the front surface of the planar receiving space on the main body 8.

The pivoting clip 7 includes an upper main section 7A and a diagonal lower section 7B. The lower section 7B includes a lower serrated edge 22 hat is forcibly presses against the opposing planar receiving space and the indentations formed between the teeth on the main body 8. As mentioned above, a least one upward, diagonally extending spike 13 is located in the receiving space 14B that extends upward and around the serrated edge 22 on the clip 7. During use, the curb 14, flat receiving space 14B, the serrated edge 22 on the clip 7, the raised teeth on the planar receiving space 14B, the indentations, and the two spikes 13 securely grip the edge of the popcorn container 3 and prevent the container 3 from being accidentally dislodged during use.

Holding device 5 also includes a downward extending rigid support arm 18 that attaches to the main body 8 and an optional extension arm 10 that attaches to the distal end of the support arm. Formed on the distal end of the support arm 18 are two hinges 12. A pin then connects the extension arm 10 to the two hinges 12.

In the preferred embodiment, the support arm 18 is approximately 1" wide and the extension arm 10 is triangular in shape with a lower wide section that acts as a wide support surface for a popcorn container 3. The purpose of this extension arm 10 is three-fold. First, it has a lower wide section that helps stabilize and prevent rocking motion which can be created by the users reaching into the container 3. Second, the extension arm 10 allows the user to fold the overall length of the holding device allowing it to be easily transported in a pocket, purse or glove compartment. Third, the extension arm 10 provides additional advertising space.

FIG. 3 is a side elevation view of the holding device 5 showing the relative locations of the clip 7, the cup holder sleeve 9, the handle 6, the support arm 18 and the extension arm 10. Also shown, are spikes 13 aligned at an approximate 35 degree angle and the sharp tips stick in between the second to last outside teeth 22 on both sides of the clip 7. This spike design forces the popcorn container 3 (bucket or bag) onto the two spikes 13 for an additional positive lock while keeping metal tips safely under clip 7. Also shown are the semi-coil spring 16, the hinge brackets, 19, the hinge arm 20 and the pin 21.

FIG. 4 is a top plan view of the holding device 5 showing the coil spring 16 disposed between the main body 8 and the clip 7. The coil spring 16 is aligned over the hinge pin 21 and has a closing finger pressure of 4-5 lbs which is fairly stiff and requires the hinge bracket supports 19, 20 to be approximately 0.25 inch wide to support the spring pressure and weight of a full popcorn container 3.

FIG. 5 is a bottom plan view of the holding device 5 that shows how the two metal spikes 13, which are longer than the adjacent backside teeth and are positioned to rise to the top of the V-shaped opening between the outside teeth 22 and forcing the cardboard and paper material, buckets and bags are made of, onto the metal spikes for added security. The top of the outside clip 7 which has raised finger grip 18 along with a finger indentation 15 which is designed to better grip and squeeze without slippage. In looking at the bottom of the cup holder sleeve 9, includes a sleeve gap [dark area] which is 0.125 inch and expands to 0.25 inch for the different size cup holders.

FIG. 6 is an exploded, perspective view of the holding device 5 exposing the main body 8 with a spring retainer indentation 26, two inside back hinge bracket supports 19, a raised curb 14, the back teeth 23, the serrated edge 22, and the two metal spikes 13.

Figure 7:
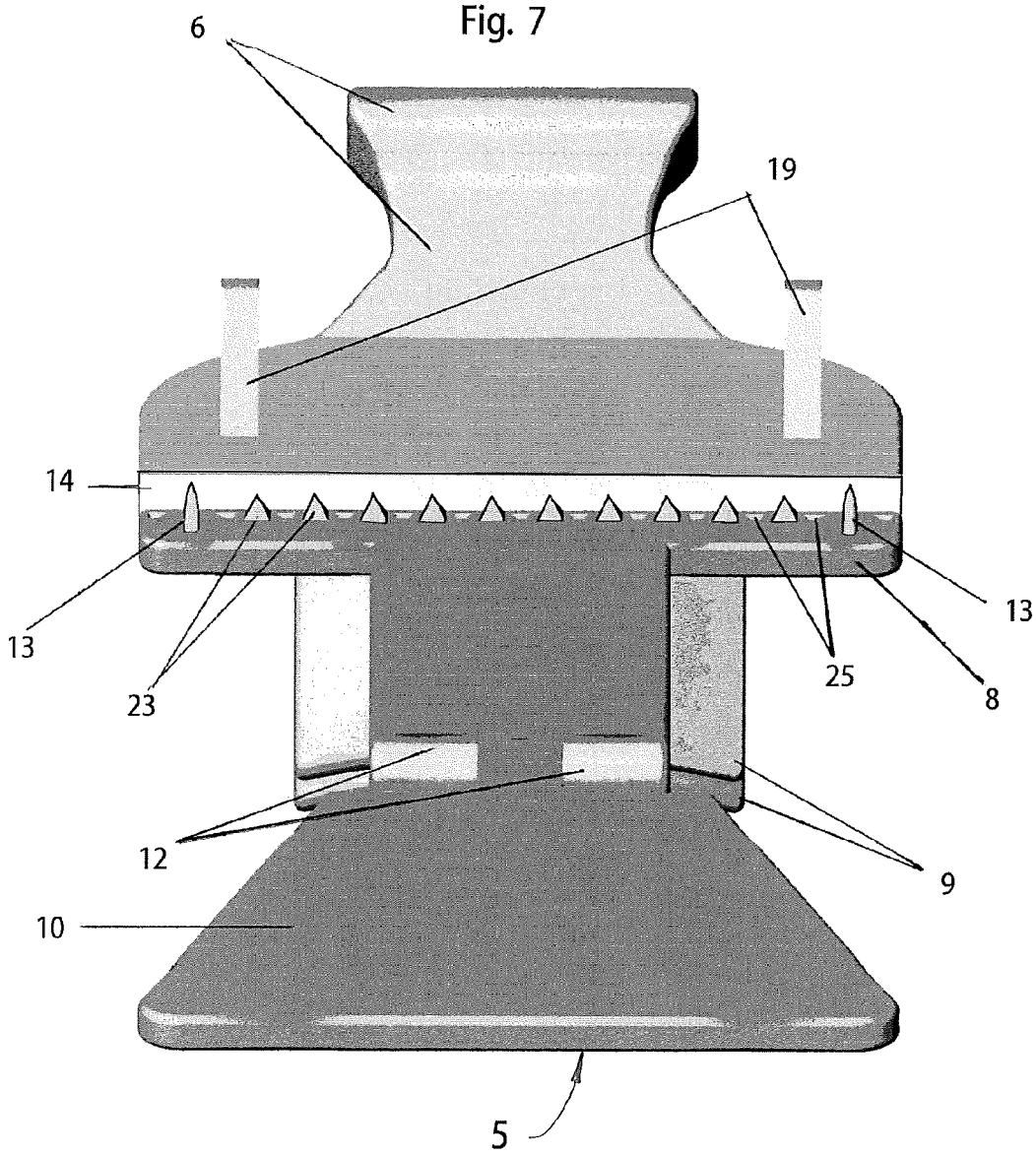
FIG. 7 is a bottom plan view of the invention shown in FIGS. 2-6.
Figure 8:
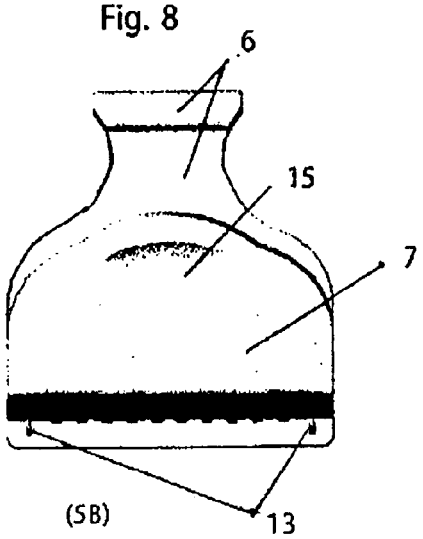
FIG. 8 is a front view of a second embodiment of the invention.
Figure 9:
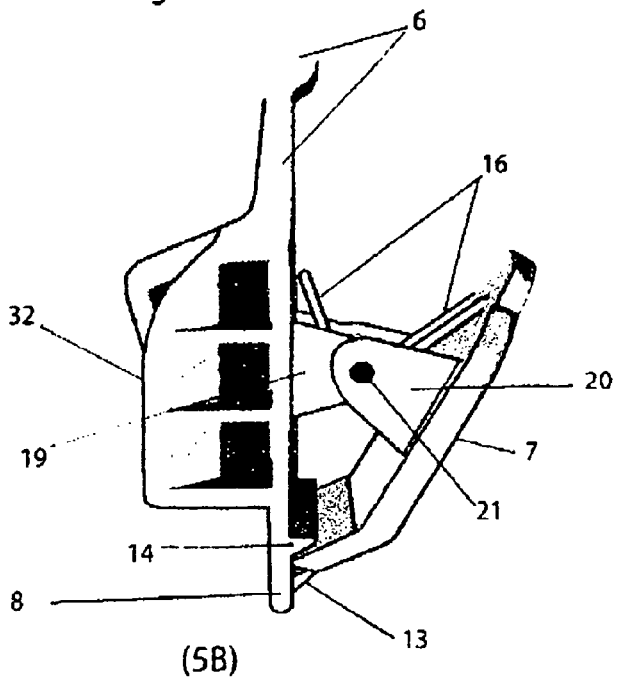
FIG. 9 is a side elevational view of the invention shown in FIG. 8.
Figure 10:
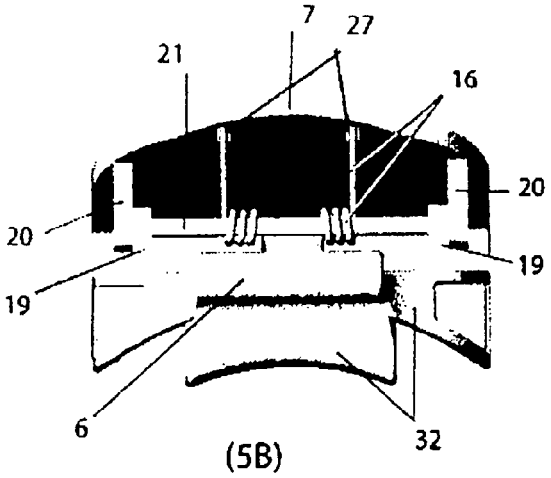
FIG. 10 is a top plan view of the invention shown in FIGS. 8 and 9.
Figure 11:
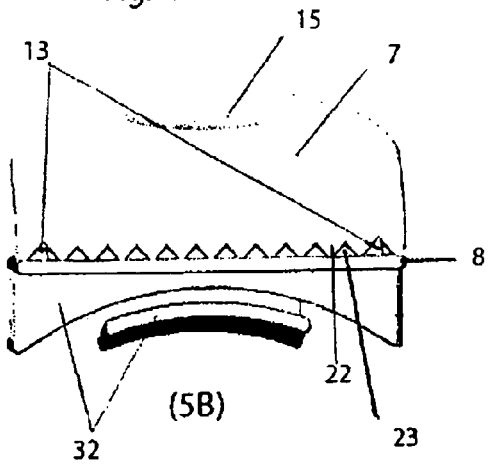
FIG. 11 is a bottom plan view of the invention shown in FIGS. 8-10.

FIG. 7 is a bottom view plan of the holding device 5 with the clip 7 removed and thereby exposing the grip handle 6, the inside hinge support brackets 19, the raised curb 14, the metal spikes 13, back inside teeth 23, and the position of the outside spike indentations 25, and the main body 8 with the support arm 16 and the extension arm 10 when attached.

FIGS. 8, 9, 10 and 11 are front, side, top and bottom views, respectively, of a second embodiment of the holding device, denoted by reference number 5B. Holding device 5B is identical to holding device 5 except that the cup sleeve 32 is integrally formed with the main body 8 and the support arm 18 and pivoting extension arm 10 have been eliminated. The handle 6 is also longitudinally aligned with the main body 8. The holding device 5B is simpler and less expensive and will accommodate cup holders mounted on the chair backs.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A spectator seat beverage cup popcorn container holding device, comprising:

a. a planar main body that includes a longitudinal axis, a rear surface, a front surface, and a lower edge, said front surface includes a forward extending, transversely aligned curb located on said front surface, said curb being located on said front surface so that a planar receiving space is created between said curb and said lower edge;

b. a spectator seat beverage cup engaging structure mounted to said rear surface of said main body, said spectator seat beverage cup engaging structure being longitudinally aligned so that said spectator seat beverage cup engaging structure and said main body are diagonally aligned and diverge;

c. a handle mounted on said main body, said handle extends upward from said main body in a direction opposite to said lower edge;

d. at least one diagonally upward extending spike located on said main body and within said planar receiving space;

e. a clip pivotally attached to said main body, said clip includes a clip body with an upper edge and a lower edge, said clip has a length and width so that said lower edge may be forcible pressed against said planar receiving space, and;

f. a means for biasing said clip so that when said upper edge is released, said lower edge on said clip presses against said receiving space to forcible hold the edge of a popcorn container positioned over said receiving space.

2. The spectator seat beverage cup popcorn container holding device, as recited in claim 1, further including a linear serrated surface located within said receiving space, and an opposing serrated edge formed on said lower edge of said clip, said linear serrated surface and said opposing serrated edge able to mesh when said clip is released.

3. The spectator seat beverage cup popcorn container holding device, as recited in claim 1, wherein said handle includes a rounded top edge and narrow neck with two opposite end surfaces that enables said handle to be gripped with one hand either front to back or side to side.

4. The spectator seat beverage cup popcorn container holding device, as recited in claim 1, wherein said spectator seat beverage cup engaging structure is a beverage cup holder edge engaging structure.

5. The spectator seat beverage cup popcorn container holding device, as recited in claim 1, further including a rigid planar support arm longitudinally aligned extending from said main body opposite said handle.

6. The spectator seat beverage cup popcorn container holding device, as recited in claim 5, further including an extension arm longitudinally aligned and pivotally attached at one end to said support arm.

7. The spectator seat beverage cup popcorn container holding device, as recited in claim 5, wherein said extension arm includes a lower wide section that increase the stability of the lower portion of said popcorn container when attached to said clip.

8. The spectator seat beverage cup popcorn container holding device as recited in claim 2, wherein said handle includes a rounded top edge and narrow neck with two opposite end surfaces that enables said handle to be gripped with one hand either front to back or side to side.

9. The spectator seat beverage cup popcorn container holding device as recited in claim 2, wherein said spectator seat beverage cup engaging structure is a beverage cup holder edge engaging structure.

10. The spectator seat beverage cup popcorn container holding device, as recited in claim 2, further including a rigid planar support arm longitudinally aligned and extending downward from said main body opposite said handle.

11. The spectator seat beverage cup popcorn container holding device, as recited in claim 2, further including said support arm having a distal end and an extension arm longitudinally aligned and pivotally attached to said distal end on said support arm.

12. The spectator seat beverage cup popcorn container holding device, as recited in claim 10, further including said support arm having a distal end an extension arm longitudinally aligned and pivotally attached at one end on said support arm.

13. The spectator seat beverage cup popcorn container holding device, as recited in claim 3, wherein said spectator seat beverage cup engaging structure is a beverage cup holder edge engaging structure.

14. The spectator seat beverage cup popcorn container holding device, as recited in claim 3, further including a rigid planar support arm longitudinally aligned extending from said main body opposite said handle.

15. The spectator seat beverage cup popcorn container holding device, as recited in claim 14, further including an extension arm longitudinally aligned and pivotally attached at one end to said support arm.

16. The spectator seat beverage cup popcorn container holing device, as recited in claim 3, further including an extension arm longitudinally aligned and pivotally attached at one end to said support arm.

17. The spectator seat beverage cup popcorn container holding device, as recited in claim 4, further including a rigid planar support arm longitudinally aligned extending from said main body opposite said handle.

18. The spectator seat beverage cup popcorn container holding device, as recited in claim 17, further including an extension arm longitudinally aligned and pivotally attached at one end to said support arm.

* * * * *